US011944916B1

(12) United States Patent
Cerny et al.

(10) Patent No.: US 11,944,916 B1
(45) Date of Patent: Apr. 2, 2024

(54) SECUREMENT ASSEMBLY FOR TOY

(71) Applicant: Mattel, Inc., El Segundo, CA (US)

(72) Inventors: Benjamin M. Cerny, Williamsville, NY (US); Benjamin Thomas Brooks, Williamsville, NY (US); Kevin M. Gastle, Boston, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 18/485,596

(22) Filed: Oct. 12, 2023

(51) Int. Cl.
*A63H 3/50* (2006.01)
*A63H 3/52* (2022.01)

(52) U.S. Cl.
CPC *A63H 3/50* (2013.01); *A63H 3/52* (2013.01)

(58) Field of Classification Search
CPC ..... A63H 3/50
See application file for complete search history.

(56) References Cited

U.S. PATENT DOCUMENTS 2,620,539 A * 12/1952 Poupitch ..... F16B 5/10 29/446
2,622,835 A * 12/1952 Ippolito ..... A63H 3/50 248/346.06
3,207,094 A * 9/1965 Kass ..... A63H 3/50 108/50.12
3,407,454 A * 10/1968 Myatt ..... F16B 21/02 411/549
4,141,176 A * 2/1979 Flicker ..... A63H 3/20 446/361
4,186,516 A * 2/1980 Ensmann ..... A63H 7/02 446/238
5,209,694 A * 5/1993 Utt, Jr. ..... A63H 3/50 248/176.1
5,411,138 A 5/1995 Klawiter
5,522,758 A * 6/1996 Liu ..... A63H 13/00 40/411
5,611,432 A 3/1997 Dods
5,896,991 A * 4/1999 Hippely ..... B65D 75/36 206/781
6,273,656 B1 8/2001 Cleland et al.
7,296,679 B2 11/2007 Lam
8,133,090 B2 * 3/2012 Hardin ..... A63H 3/50 446/268
8,657,106 B2 2/2014 Trapp et al.
9,108,116 B2 * 8/2015 Swartz ..... A63H 3/50
2007/0087651 A1 * 4/2007 Ali ..... A63H 33/26 446/137

(Continued)

FOREIGN PATENT DOCUMENTS

WO 2021237003 A1 11/2021

*Primary Examiner* — Kurt Fernstrom
(74) *Attorney, Agent, or Firm* — Edell, Shapiro & Finnan, LLC

(57) ABSTRACT

A securement assembly for a toy includes a support having an insert with a plurality of tabs cooperatively defining a space, the insert being configured to extend into a receptacle of the toy. The securement assembly also includes a stand with an extension configured to extend into the space cooperatively defined by the plurality of tabs so that, in an assembled configuration of the securement assembly, the extension abuts the plurality of tabs to move the plurality of tabs away from one another and into engagement with a wall of the toy defining the receptacle.

20 Claims, 16 Drawing Sheets

(56) References Cited

U.S. PATENT DOCUMENTS

| | | | | |
|---|---|---|---|---|
| 2007/0117494 | A1* | 5/2007 | Sheller | A63H 13/18<br>446/309 |
| 2013/0186790 | A1 | 7/2013 | Brandinelli | |
| 2014/0011421 | A1* | 1/2014 | Martinez | A63H 3/50<br>446/73 |
| 2021/0213366 | A1 | 7/2021 | Dore et al. | |

* cited by examiner

SECUREMENT ASSEMBLY FOR TOY

TECHNICAL FIELD

The present application relates generally to toys and, in particular, to a securement assembly configured to couple to and support a toy.

BACKGROUND

Toys provide entertainment for different users, such as children. For example, a toy may have a realistic appearance, and a user may interact with the toy to simulate real world actions. In some circumstances, it may be desirable to support the toy, such as to secure the toy in place to restrict certain movement of the toy. For example, securement of the toy may provide desirable display of the toy (e.g., when the user is not interacting with the toy). Securement of the toy may additionally or alternatively position the toy at a certain location, such as within an enclosure and/or with respect to other toys. Therefore, securement of the toy may further enhance some entertainment aspects provided to a user.

SUMMARY

A securement assembly for a toy is presented herein. According to one example embodiment, the securement assembly includes a support with an insert, the insert having a plurality of tabs cooperatively defining a space, and the insert being configured to extend into a receptacle of the toy. The securement assembly also includes a stand with an extension, the extension being configured to extend into the space cooperatively defined by the plurality of tabs so that, in an assembled configuration of the securement assembly, the extension abuts the plurality of tabs to move the plurality of tabs away from one another and into engagement with a wall of the toy defining the receptacle.

Other systems, methods, features and advantages will be, or will become, apparent to one with skill in the art upon examination of the following figures and detailed description. All such additional systems, methods, features, and advantages are included within this description and are within the scope of the claimed subject matter.

BRIEF DESCRIPTION OF THE DRAWINGS

The toy securement assembly presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy figure. In the figures, like-referenced numerals designate corresponding parts throughout the different views.

DETAILED DESCRIPTION

Overall, a securement assembly for a toy is presented herein. The securement assembly includes a support having a support base and an insert extending from the support base. The insert includes a plurality of tabs cooperatively defining a space, and the insert is configured to extend into a receptacle of the toy. The securement assembly also includes a stand with a stand base and an extension extending from the stand base. The extension is configured to extend into the space cooperatively defined by the plurality of tabs so that, in an assembled configuration of the securement assembly, the extension abuts the plurality of tabs to move the plurality of tabs away from one another and into engagement with a wall of the toy defining the receptacle.

Figure 1:
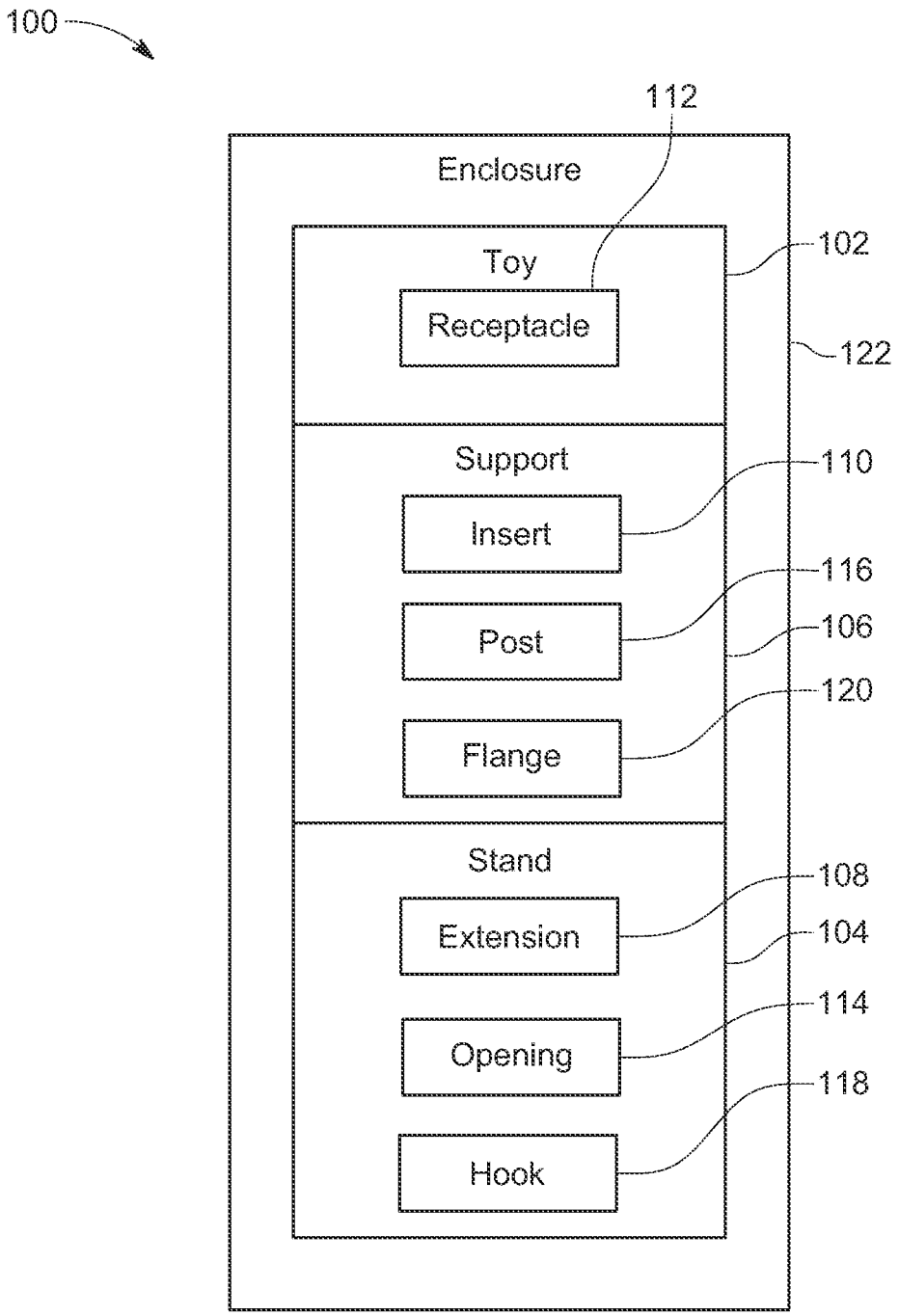
FIG. 1 illustrates a schematic diagram of a securement assembly, in accordance with an example embodiment of the present application.

FIG. 1 illustrates a schematic diagram of an embodiment of a securement assembly 100 configured to couple to a toy 102 (e.g., a toy figure). The securement assembly 100 includes a stand 104 and a support 106. The stand 104 and the support 106 are configured to couple to one another in an assembled configuration of the securement assembly 100. For example, the stand 104 includes an extension 108, and the support 106 includes an insert 110. The insert 110 defines a space, and the extension 108 is configured to insert into the space to engage with the insert 110, thereby coupling the stand 104 and the support 106 to one another. The extension 108 and the insert 110 are configured to extend into a receptacle 112 of the toy 102 to couple to the toy 102. For example, the insert 110 abuts a wall of the toy 102 defining the receptacle 112 to secure the assembled stand 104 and support 106 to the toy 102. Coupling of the toy 102, the stand 104, and the support 106 to one another positions the support 106 generally between the toy 102 and the stand 104.

The stand 104 and the support 106 include additional features to facilitate coupling to one another. For example, the stand 104 includes an opening 114, and the support 106 includes a post 116 configured to extend into the opening 114. In some embodiments, the opening 114 includes a recess, and the stand 104 is configured to capture the post 116 within the recess to block relative movement between the stand 104 and the support 106. The stand 104 also includes a hook 118, and the support 106 includes a flange 120. The hook 118 is configured to capture the flange 120 to hold the support 106 against the stand 104. Thus, the opening 114 and the hook 118 of the stand 104 and the post 116 and the flange 120 of the support 106 may further maintain the securement assembly 100 in the assembled configuration.

In certain embodiments, the securement assembly 100 further includes an enclosure 122. The enclosure 122 may provide additional securement features for the toy 102, such as by positioning the toy 102 in a desirable manner. To this end, the stand 104 is configured to couple to the enclosure 122. As an example, the stand is configured to couple to the enclosure 122 via an interference fit, a fastener, an adhesive, any other suitable technique, or any combination thereof. Coupling of the stand 104 to the enclosure 122 may block relative movement between the stand 104 and the enclosure 122, thereby securing the toy 102 coupled to the stand 104 to the enclosure 122. Moreover, in certain embodiments, coupling of the support 106 and the toy 102 to one another orients the toy 102 in a particular manner (e.g., facing a particular direction) with respect to the stand 104. Additionally, coupling the stand 104 to the enclosure 122 orients the stand 104 in a particular manner (e.g., facing a particular direction) with respect to the enclosure 122. Thus, coupling of the toy 102, the stand 104, the support 106, and the enclosure 122 to one another may orient the toy 102 in a particular manner (e.g., facing a particular direction) with respect to the enclosure 122 to position the toy 102 desirably.

Figure 2:
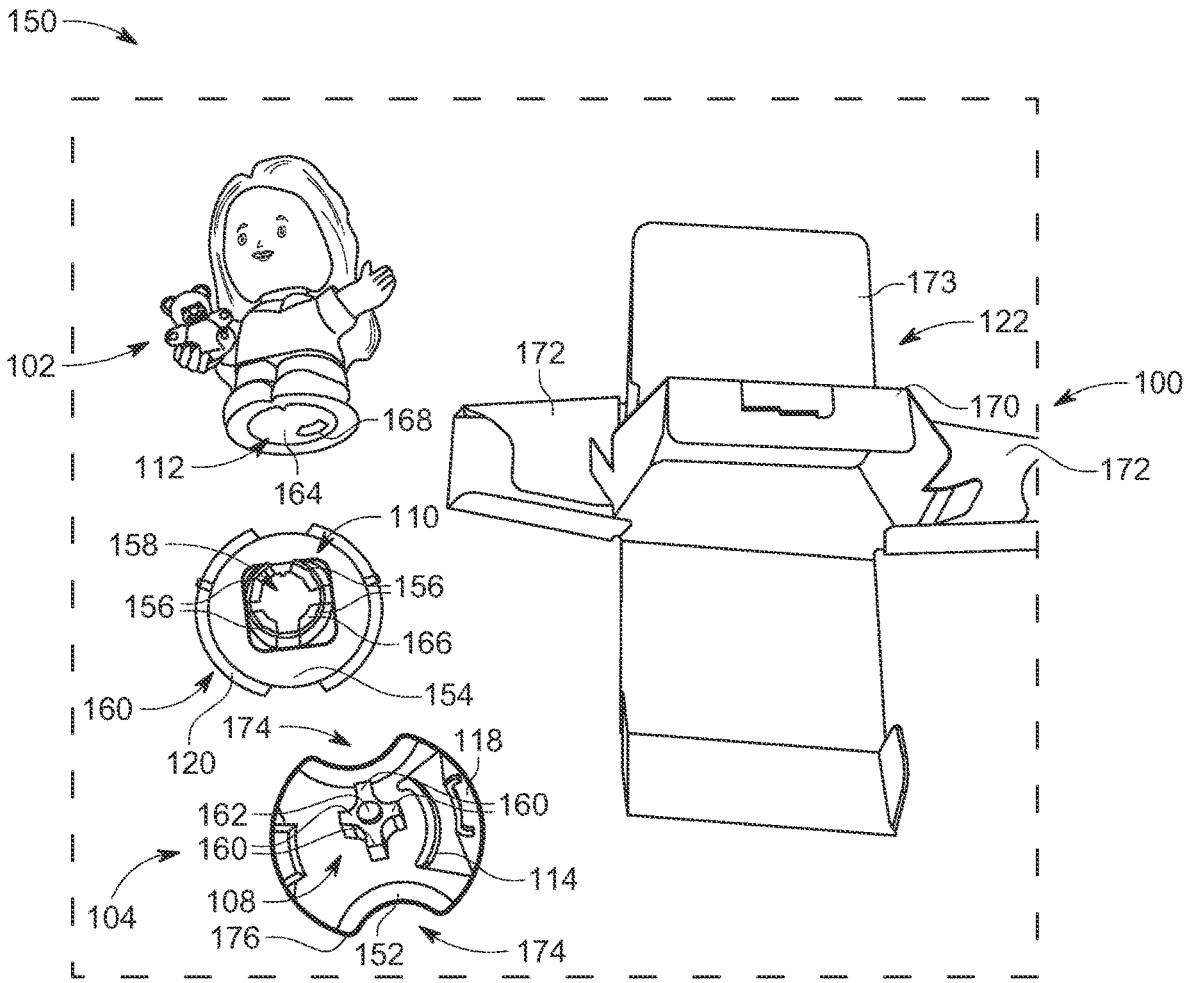
FIG. 2 illustrates a kit that includes a toy and a securement assembly for the toy, in accordance with an example embodiment of the present application.

FIG. 2 illustrates an embodiment of a kit 150 that includes the toy 102 and the securement assembly 100 with the stand 104, the support 106, and the enclosure 122. As an example, the kit 150 may be provided with the toy 102, the stand 104, the support 106, and the enclosure 122 as separate components to be assembled (e.g., manually assembled) together. That is, the toy 102, the stand 104, the support 106, and the enclosure 122 may not be initially assembled within the kit 150. For instance, the kit 150 may be provided by a manufacturer, a vendor, and/or a supplier to a customer and/or a seller.

The stand 104 includes a stand base 152 and the extension 108 extending from the stand base 152. The support 106 includes a support base 154 and the insert 110 extending from the support base 154. The insert 110 includes a plurality of tabs 156 extending from the support base 154 and cooperatively defining a space 158 therebetween. The extension 108 is configured to extend into the space 158 to couple the stand 104 and the support 106 to one another. By way of example, the extension 108 includes projections 160 extending outward (e.g., radially outward) from a central portion 162. Positioning of the extension 108 within the space 158 may abut the projections 160 against the tabs 156, thereby engaging the extension 108 with the insert 110 to secure the support 106 to the stand 104.

The engagement of the extension 108 with the insert 110 may also facilitate securement of the securement assembly 100 to the toy 102. For example, engagement of the projections 160 with the tabs 156 may push the tabs 156 outwardly (e.g., away from one another to increase a size of the space 158). To this end, the tabs 156 may be composed of a sufficiently pliable material, such as a polymer (e.g., polyvinyl chloride). Outward movement of the tabs 156 may enable the tabs 156 to push against a wall or walls 164 of the toy 102 that define the receptacle 112. That is, the projections 160 move the tabs 156 into contact with the wall 164 to provide sufficient friction between the tabs 156 and the toy 102, thereby blocking movement of the support 106, as well as the stand 104 coupled to the support 106, relative to the toy 102. In certain embodiments, each tab includes ribs or teeth 166 that extend (e.g., outwardly extend) away from the space 158. The ribs 166 may further help secure the support 106 to the toy 102. For example, the ribs 166 may concentrate a force (e.g., a frictional force) imparted onto the toy 102 to help secure the support 106 to the toy 102. Thus, movement of the tabs 156 via the extension 108 may cause the ribs 166 to press into the wall 164.

The toy 102 also includes a cutout 168 formed into a portion of the wall 164 in the illustrated embodiment. The cutout 168 may be configured to receive one of the ribs 166 of the support 106. For example, the cutout 168 may be sized to enable positioning of the rib 166 therein, and the portion of the wall 164 surrounding the cutout 168 may capture the rib 166, further blocking movement of the support 106 with respect to the toy 102. The cutout 168 may also help orient the toy 102 in a desirable manner with respect to the support 106. That is, a particular orientation (e.g., an angular orientation) of the support 106 with respect to the toy 102 may position the rib 166 within the cutout 168. Thus, the engagement between the cutout 168 and the rib 166 may maintain the particular orientation of the support 106 with respect to the toy 102. In some embodiments, the toy 102 may be molded (e.g., from a polymer, such as polypropylene) to provide an initial profile of the toy 102, including the receptacle 112, and the cutout 168 may be formed into the wall 164 after molding of the toy 102. In additional or alternative embodiments, the toy 102 may be molded to directly form the cutout 168. Thus, an additional operation, separate from molding of the toy 102, to form the cutout 168 may be avoided.

The stand 104 further includes the opening 114 formed through the stand base 152, such as around the extension 108. As discussed, the opening 114 is configured to receive a post 116 (not shown in FIG. 2) of the support 106 to secure the stand 104 and the support 106 to one another. Positioning of the post 116 of the support 106 within the opening 114 may restrict certain relative movement between the stand 104 and the support 106. The stand 104 also includes the hooks 118 that extend from the stand base 152. The hooks 118 are configured to capture the flanges 120 extending from the support base 154 of the support 106, further securing the stand 104 and the support 106 to one another. By way of example, capture of the flanges 120 via the hooks 118 may maintain engagement of the support base 154 against the stand base 152.

The illustrated enclosure 122 includes a foldable (e.g., manually foldable) configuration. To this end, the enclosure 122 may be composed of a sufficiently pliable material, such as a paper material. The foldability of the enclosure 122 may enable the size of the enclosure 122 to be more easily adjustable, such as to an unfolded configuration (e.g., a flattened configuration) for transportation and to a folded configuration (e.g., an upright configuration) for coupling to the stand 104. As an example, the enclosure 122 includes an enclosure base portion 170 on which the stand 104 may be placed, as well as enclosure wall portions 172 extending from an enclosure backing portion 173 and configured to fold to extend along the enclosure base portion 170. The enclosure wall portions 172 may capture the stand 104 to maintain securement of the stand 104 to the enclosure 122. For instance, the stand base 152 may include notches 174 that are formed into the stand base 152 (e.g., at opposite sides of the stand base 152) to provide edges 176. The edges 176 may be configured to engage with the enclosure wall portions 172. For example, the enclosure wall portions 172 may capture the edges 176 to hold the stand 104 against the enclosure 122, such as on the enclosure base portion 170. In some embodiments, a particular orientation (e.g., an angular orientation) of the stand 104 with respect to the enclosure 122 (e.g., the enclosure wall portions 172) may place the edges 176 in engagement with the enclosure wall portions 172. As such, the engagement between the edges 176 and the enclosure wall portions 172 may maintain the particular orientation of the stand 104 with respect to the enclosure 122. For instance, such orientation of the stand 104 with respect to the enclosure 122 may also position the toy 102 coupled to the stand 104 at a particular orientation with respect to the enclosure 122.

Figure 3:
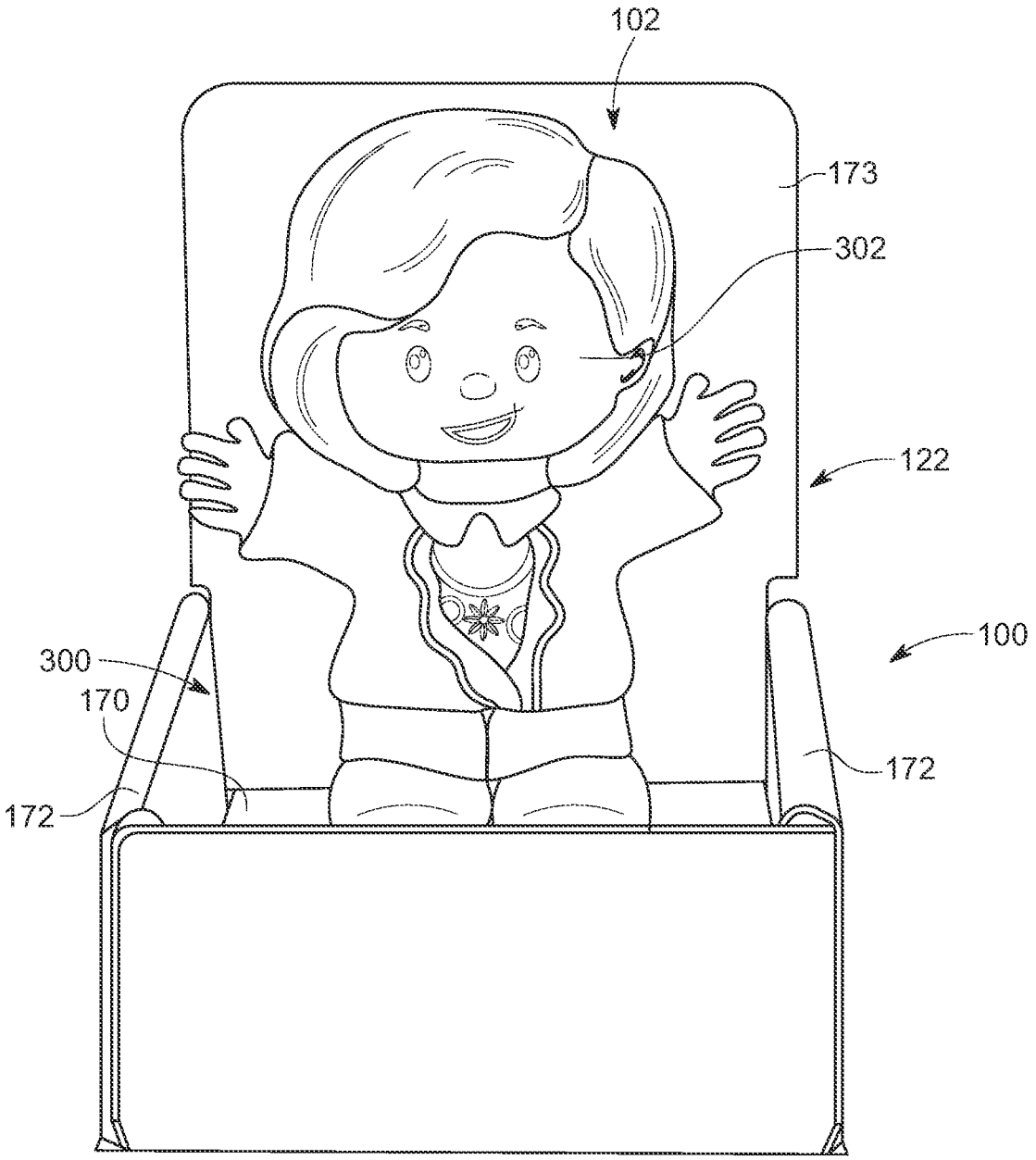
FIG. 3 illustrates a front perspective view of a toy coupled to a securement assembly, in accordance with an example embodiment of the present application.

FIG. 3 illustrates a front perspective view of the toy 102 coupled to the securement assembly 100. For example, the enclosure 122 is in the folded configuration, the stand 104 and the support 106 (not shown in FIG. 3) are coupled to one another and positioned in the enclosure 122, and the toy 102 is coupled to the support 106. The illustrated enclosure 122 forms a seat 300 via the enclosure base portion 170, the enclosure wall portions 172, and the enclosure backing portion 173, and the stand 104 is positioned within the seat 300, on the enclosure base portion 170, and between (e.g., in engagement with) the enclosure wall portions 172 to secure to the enclosure 122. Such positioning of the stand 104 with respect to the enclosure 122 also positions a portion of the toy 102 between the enclosure wall portions 172 (e.g., the toy 102 extends partially within the seat 300), while a remainder of the toy 102 may extend clear of the enclosure wall portions 172 (e.g., the toy 102 extends partially out of the seat 300). Thus, a part of the toy 102 may be exposed and visible.

Moreover, the securement of the toy 102 to the securement assembly 100, which may be effectuated by particular orientations of the stand 104 with respect to the securement assembly 100 and of the toy 102 with respect to the stand 104, orients the toy 102 in a particular manner, such as to arrange a surface 302 (e.g., a front, a face) of the toy 102 to face away from the enclosure backing portion 173. Thus, the toy 102 may face forward in the illustrated orientation. Such orientation of the toy 102 may increase visibility of the surface 302 to provide a desirable display and appearance of the toy 102.

Consequently, the illustrated securement of the toy 102 with the securement assembly 100 may present the toy 102 for display or packaging, such as for viewing and/or some interaction by a user. Thus, the securement assembly 100 may function as a packaging element or a toy packaging security element. In such embodiments, the securement assembly 100 may block easy removal (e.g., via a manually applied force) of the toy 102. As such, additional components, such as plastic packaging (e.g., a blister pack), that otherwise may be used to provide securement of the toy 102, may be avoided to reduce material consumption and/or time associated with assembly/manufacture. Furthermore, because such additional components may reduce accessibility to some parts of the toy 102, eliminating the usage of the additional components may improve interactions with the toy 102 without the removal or decoupling of the toy 102 from the securement assembly 100. However, in some embodiments, certain protective or shielding material, such as a poly bag or protective lining, may be implemented on the toy 102 to block wearing of the toy 102 (e.g., deformation of the surface 302 of the toy 102, wearing of paint applied to the toy 102).

Although the illustrated securement assembly 100 includes the enclosure 122 configured to position the toy 102 primarily for display, it should be noted that the securement assembly 100 may include and/or be implemented in another component for securing the toy 102 for other purposes. By way of example, the securement assembly 100 (e.g., the stand 104, the support 106) may include or be implemented in another toy, such as a toy vehicle, a toy house, or a toy figure. Thus, the securement assembly 100 may serve as an interactive security element and may be used to position the toy 102 with respect to another toy, which may improve an interaction with the toy 102 (e.g., and with other toys).

Figure 4:
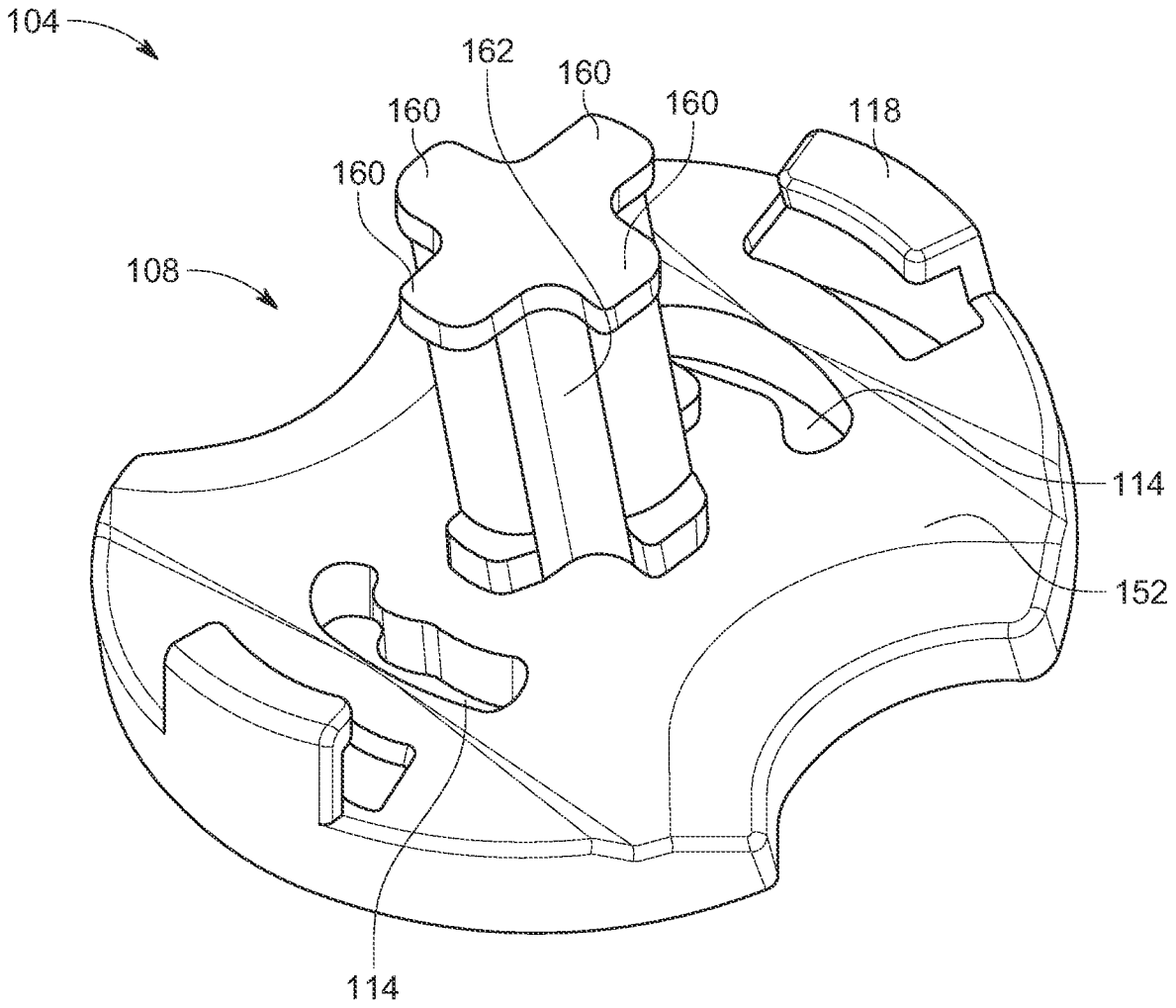
FIG. 4 illustrates a top perspective view of a stand of a securement assembly, in accordance with an example embodiment of the present application.

FIG. 4 illustrates a top perspective view of an example embodiment of a stand 104. The illustrated stand 104 includes two openings 114 formed through the stand base 152 and two hooks 118 extending from the stand base 152, as well as four projections 160 extending from the central portion 162 of the extension 108. Moreover, the stand 104 generally includes a circular or elliptical profile. However, in additional or alternative embodiments, the stand 104 may include any suitable quantity of openings 114, of hooks 118, and/or of projections 160, as well as any other suitable shape (e.g., a prismatic shape, an irregular shape).

Figure 5:
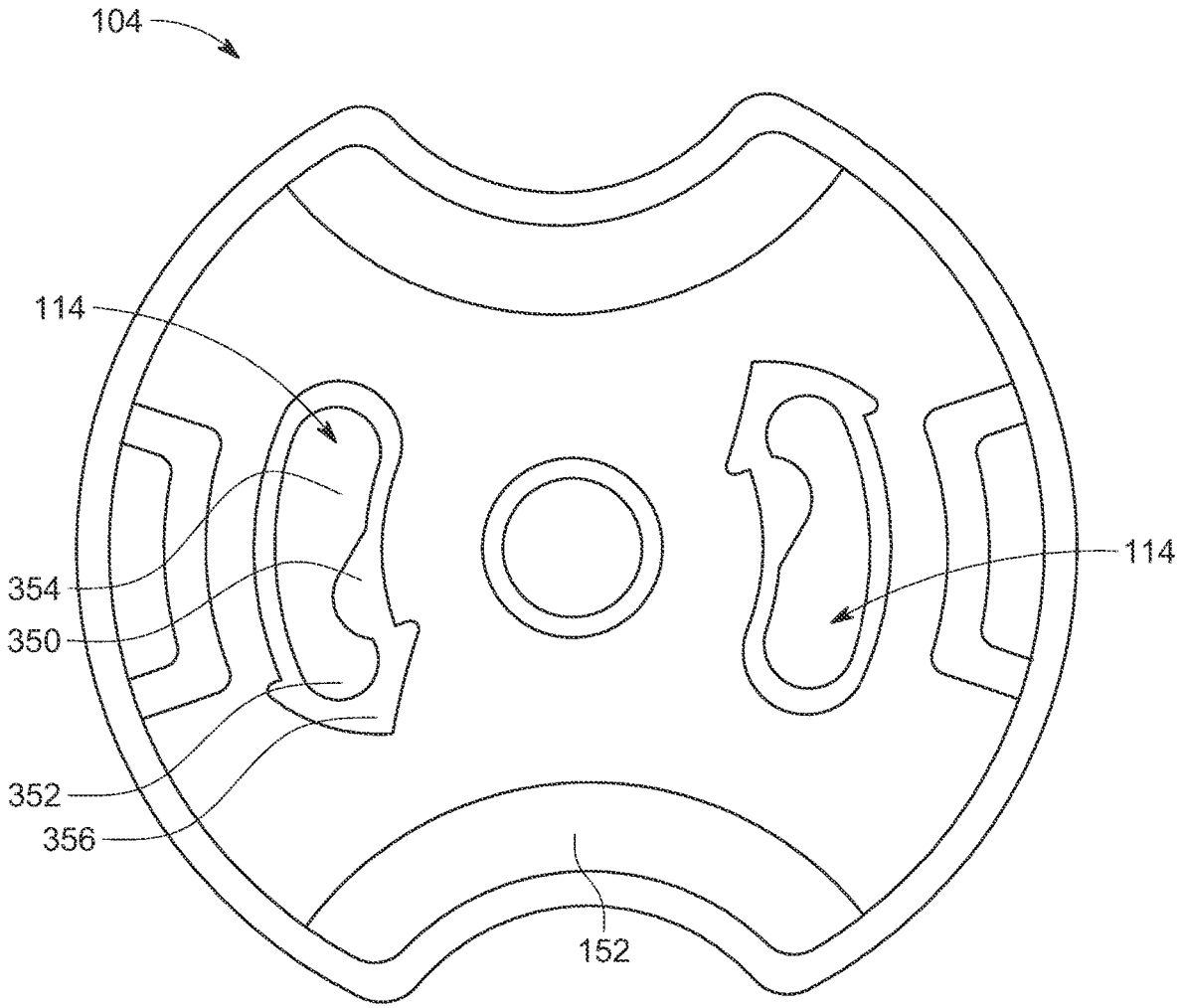
FIG. 5 illustrates a bottom view of the stand of FIG. 4.

FIG. 5 illustrates a bottom view of the stand 104. Each of the openings 114 formed in the stand base 152 includes a protrusion 350 extending therein, which defines a recess 352 and a main portion 354 within each opening 114. The recess 352 may help capture a corresponding post 116 (see FIG. 7) of the support 106 within the opening 114 to secure the stand 104 and the support 106 to one another. For example, the post 116 may initially be inserted into the main portion 354 of the opening 114, and the support 106 may be moved (e.g., rotated) relative to the stand 104 to move the post 116 from the main portion 354 into the recess 352. The stand base 152 also includes indicators 356 that indicate a direction in which the support 106 is to be moved to relative to the stand 104 to secure the stand 104 and the support 106 to one another. For example, in this embodiment, the indicators 356 include arrows that show a direction of rotation of the support 106 relative to the stand 104 to move each post 116 into a corresponding recess 352.

Figure 6:
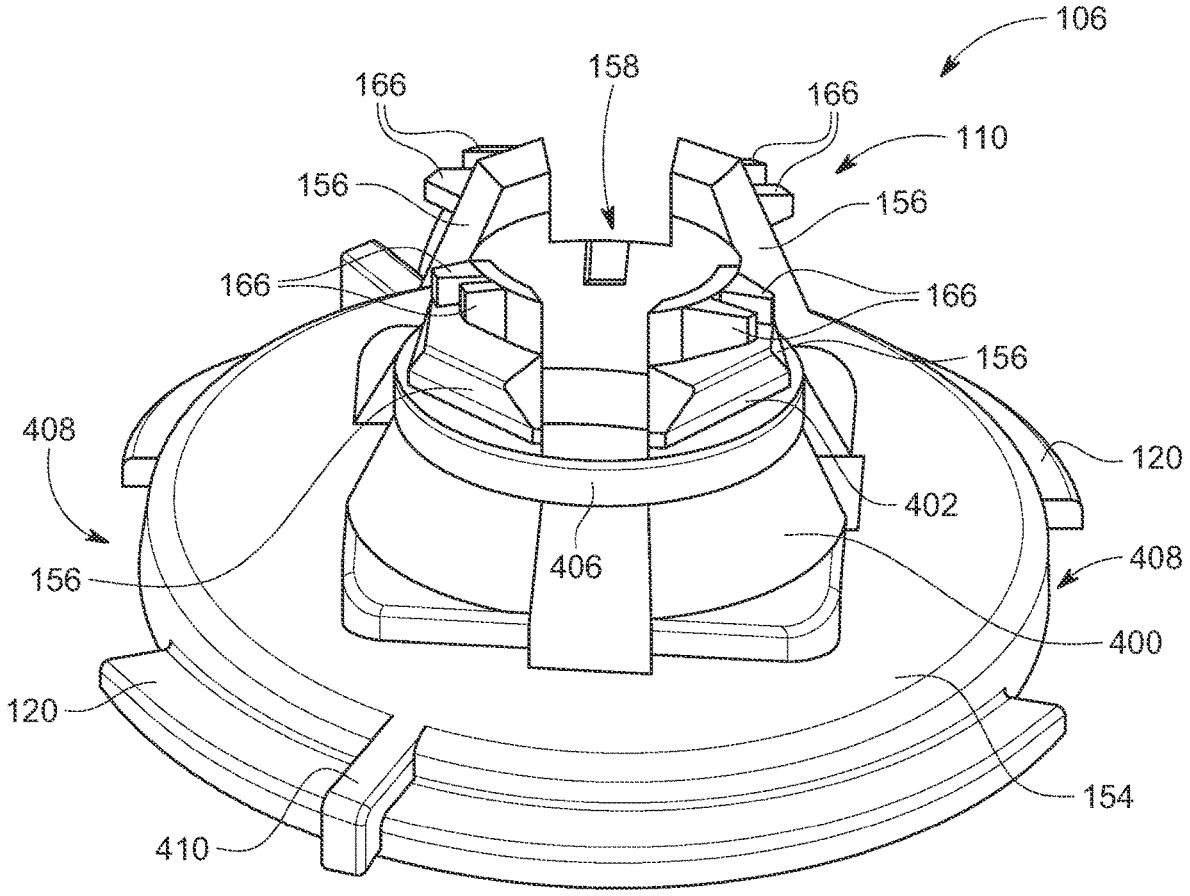
FIG. 6 illustrates a top perspective view of a support of a securement assembly, in accordance with an example embodiment of the present application.

FIG. 6 is a top perspective view of the support 106. The support 106 includes tabs 156 extending from the support base 154 to form the space 158 configured to receive the extension 108 of the stand 104. For example, each tab 156 includes a fixed portion 400 extending from the support base 154, a neck portion 402 extending from the fixed portion 400, and a movable portion 404 (e.g., from which the ribs 166 extend) extending from the neck portion 402. The neck portion 402 may have a thinner cross-sectional area than that of the fixed portion 400 and of the movable portion 404 to facilitate movement of the movable portion 404 relative to the fixed portion 400. In other words, the relatively smaller thickness of the neck portion 402 may increase flexibility of the neck portion 402 to enable the movable portion 404 to be more readily movable about the fixed portion 400. For example, positioning of the extension 108 within the space 158 may place the extension 108 in engagement with the movable portions 404 to urge the movable portions 404 to move relative to the fixed portions 400 (e.g., outwardly away from one another) via the neck portions 402.

The support 106 also includes a ring 406 coupled to the tabs 156, such as to each fixed portion 400 and/or to each neck portion 402. The ring 406 may block undesirable (e.g., excessive) movement of the tabs 156 (e.g., of the movable portion 404 and/or of the fixed portion 400). As an example, the ring 406 may block movement of the fixed portions 400 relative to the support base 154 (e.g., caused by engagement of the extension 108 with the tabs 156). Thus, the ring 406 may correspondingly reduce movement of the movable portions 404 relative to the support base 154. For instance, the ring 406 may block movement of the tabs 156 (e.g., of the movable portions 404) beyond a threshold relative to the support base 154, which may otherwise cause deformation (e.g., plastic deformation) that undesirably changes a geometry (e.g., reduced a structural integrity of) the tabs 156. As such, the ring 406 may help maintain a desirable configuration of the support 106.

The support 106 further includes flanges 120 extending from the support base 154, such as radially outward along a portion of a perimeter (e.g., a circumference) of the support base 154. The illustrated flanges 120 have a relatively smaller thickness than that of the support base 154, which may help with capture of the flange 120 via the hooks 118 of the stand 104. However, the flanges 120 may have any suitable thickness with respect to the support base 154 in additional or alternative embodiments. The flanges 120 are also separated from one another by gaps 408 extending alongside a portion of the support base 154. The gaps 408 may accommodate the hooks 118 of the stand 104 to abut the stand base 152 of the stand 104 and the support base 154 of the support 106 against one another. In other words, the hooks 118 may be inserted through the gaps 408 to place the stand 104 and the support 106 against one another.

The stand 104 and the support 106 may then be rotated relative to one another to move the hooks 118 along the flanges 120, thereby enabling the hooks 118 to capture the flange 120 (e.g., and correspondingly moving the posts 116 of the support 106 into the recesses 352 of the stand 104) and blocking certain relative movement between the stand 104 and the support 106. The support 106 also includes stops 410 extending from the support base 154 and/or from the flanges 120. The stops 410 are configured to block some movement between the stand 104 and the support 106, such as excessive rotation of the support 106 relative to the stand 104. For example, rotation of the support 106 relative to the stand 104 to cause the hooks 118 to capture the flanges 120 and/or to move the posts 116 into the recesses 352 may abut the hooks 118 against the stops 410, which then blocks further rotation of the support 106 relative to the stand 104.

Figure 7:
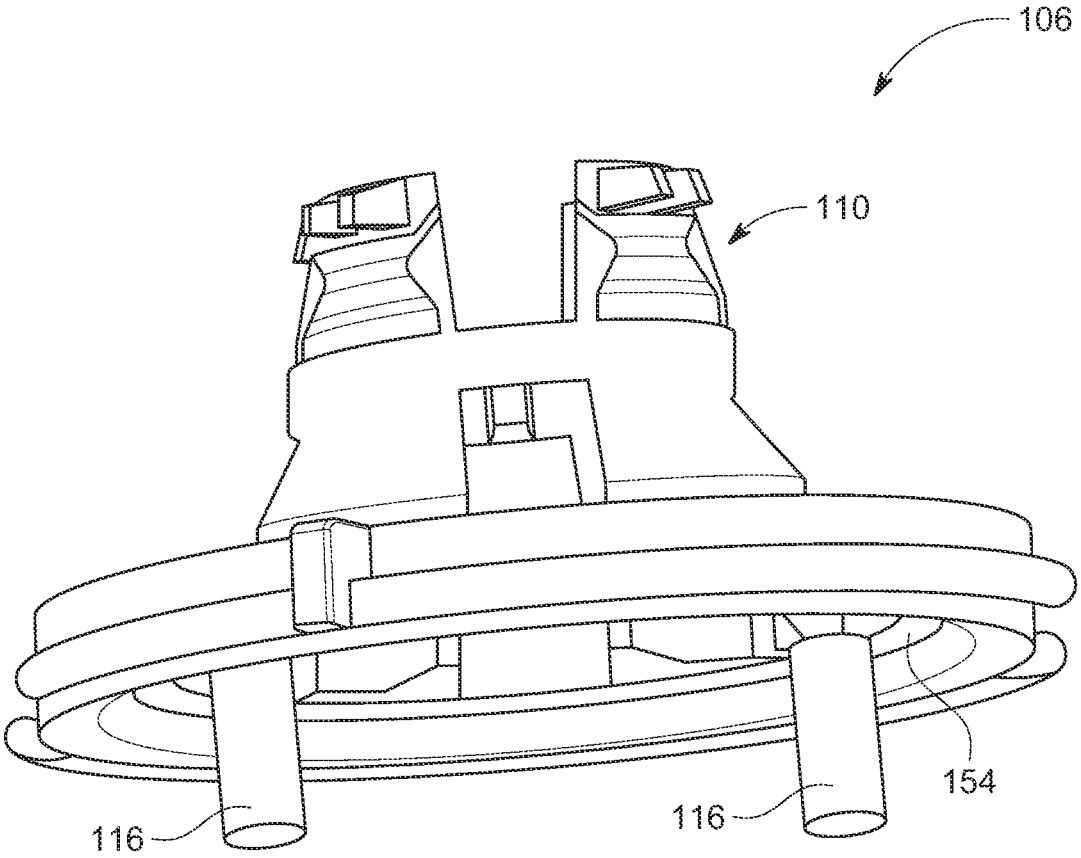
FIG. 7 illustrates a side perspective view of the support of FIG. 6.

FIG. 7 illustrates a perspective side view of the support 106. The support 106 includes the pair of posts 116 extending from the support base 154. For instance, the posts 116 and the insert 110 extend from the support base 154 in opposite directions. The posts 116 may have a suitable shape (e.g., a cylindrical shape) that enables the posts 116 to sufficiently extend into the openings 114 of the stand 104 and be captured by within the recesses 352 of the openings 114 to facilitate coupling of the stand 104 and the support 106 to one another.

Figure 8:
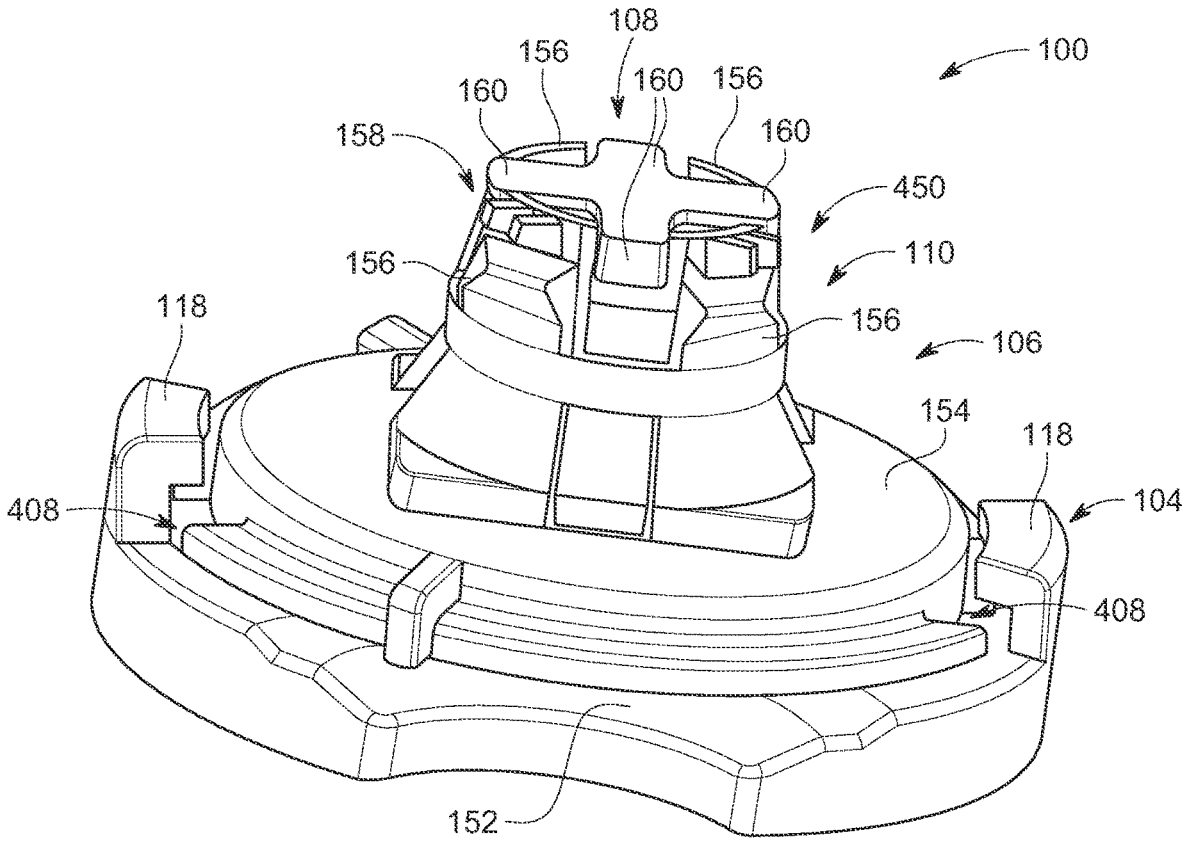
FIG. 8 illustrates a side perspective view of a securement assembly with a support and a stand coupled to one another in an unlocked configuration, in accordance with an example embodiment of the present application.

FIG. 8 illustrates a side perspective view of the securement assembly 100 with the stand 104 and the support 106 coupled to one another in an unlocked configuration 450 (e.g., a partially assembled configuration). In the unlocked configuration 450, the extension 108 is positioned within the space 158 of the insert 110, and the projections 160 of the insert 110 are positioned between adjacent tabs 156. For example, to place the securement assembly 100 in the unlocked configuration 450, the hooks 118 of the stand 104 are aligned with the gaps 408 of the support 106, and the hooks 118 are inserted through the gaps 408 to position the support 106 (e.g., the support base 154) against the stand 104 (e.g., the stand base 152).

Figure 9:
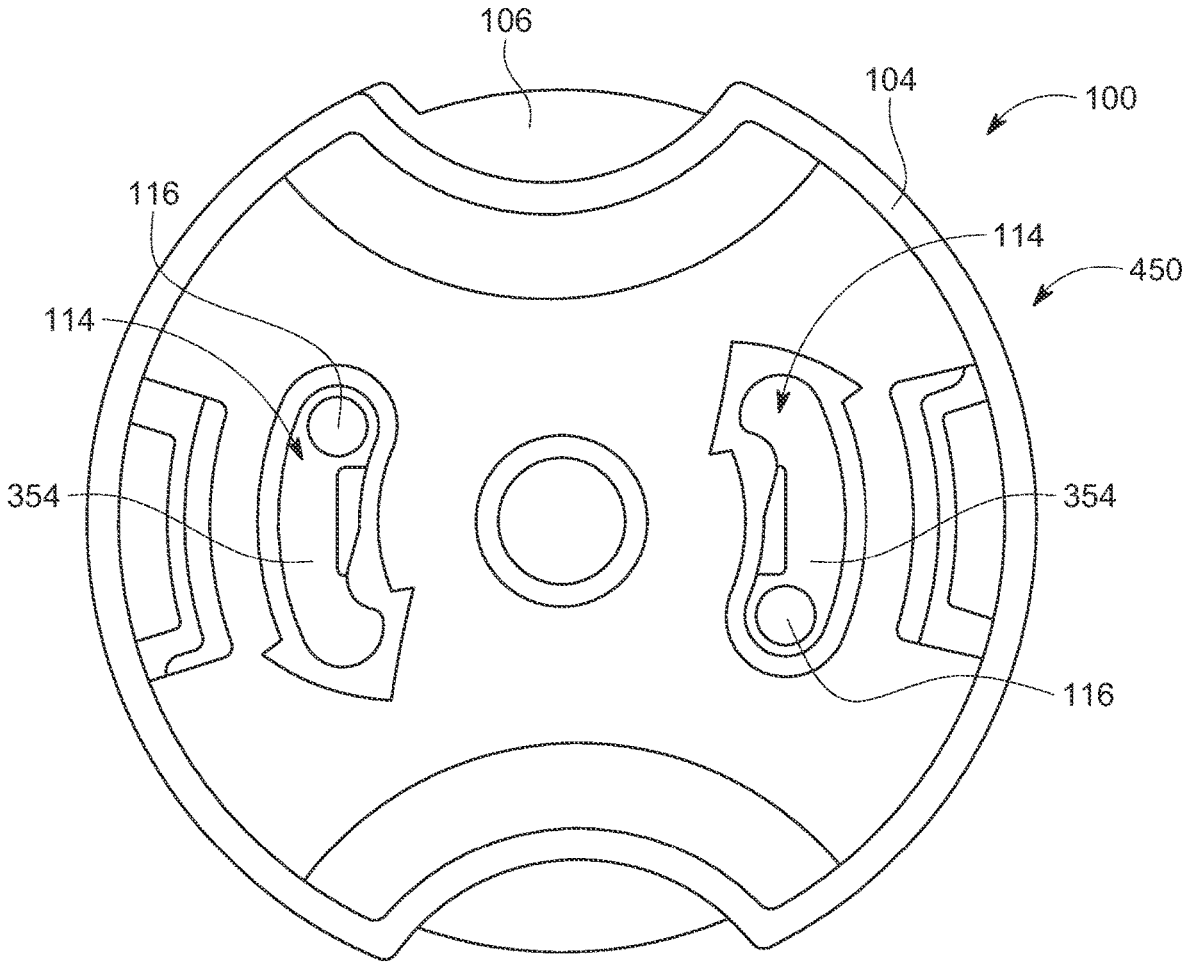
FIG. 9 illustrates a bottom view of the securement assembly of FIG. 8.

FIG. 9 illustrates a bottom view of the securement assembly 100 in the unlocked configuration 450. In the unlocked configuration 450, the posts 116 of the support 106 extend through the openings 114. In particular, the posts 116 are initially positioned within the main portion 354 of the openings 114. As an example, the main portion 354 is sized (e.g., sufficiently large) to readily accommodate the posts 116 and enable the stand 104 and the support 106 to be placed against one another.

Figure 10:
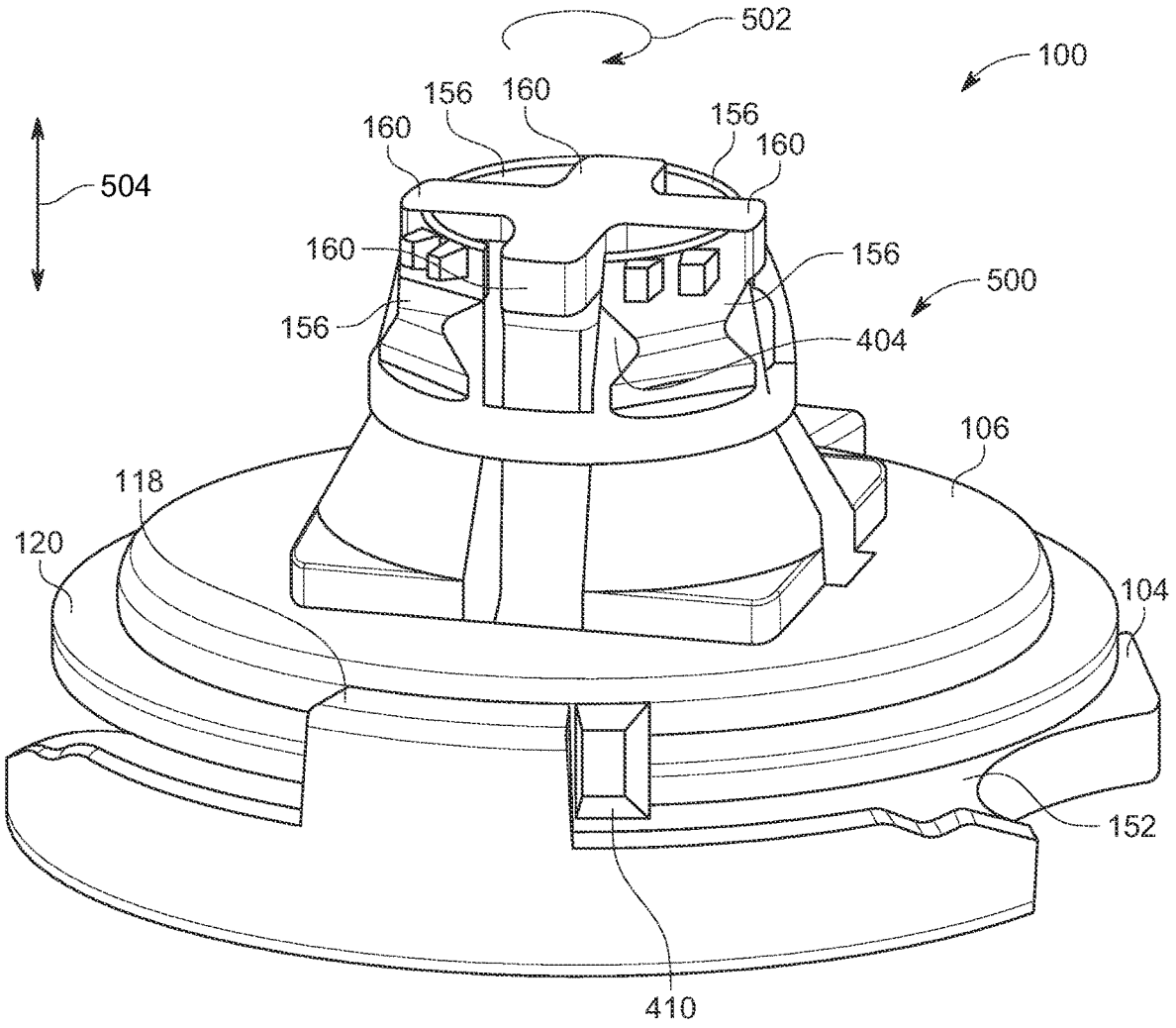
FIG. 10 illustrates a side perspective view of a securement assembly with a support and a stand coupled to one another in a locked configuration, in accordance with an example embodiment of the present application.

FIG. 10 illustrates a side perspective view of the securement assembly 100 with the stand 104 and the support 106 coupled to one another in a locked configuration 500 (e.g., a fully assembled configuration). For example, the securement assembly 100 may transition from the unlocked configuration 450 to the locked configuration 500 by rotating the support 106 in a first rotational direction 502 relative to the stand 104. Such movement of the stand 104 and the support 106 relative to one another may move the hooks 118 to extend over the flanges 120 of the support 106 instead of over the gaps 408. Thus, the hooks 118 may capture the flanges 120 between the hooks 118 and the stand base 152. The capture of the flanges 120 via the hooks 118 (e.g., abutment of the hooks 118 against the flanges 120) may block relative movement between the stand 104 and the support 106 in first directions 504 (e.g., vertical directions). Additionally, in the locked configuration 500, the hooks 118 abut the stops 410. Consequently, further relative rotational movement between the stand 104 and the support 106 (e.g., further movement of the support 106 in the first rotational direction 502 relative to the stand 104) may be blocked.

In some embodiments, in the locked configuration 500, the projections 160 may at least partially extend between adjacent tabs 156. In additional or alternative embodiments, in the locked configuration 500, the projections 160 may be circumferentially aligned with the tabs 156 (e.g., the projections 160 extend into respective tabs 156). In either case, the projections 160 move the tabs 156 (e.g., the movable portion 404) away from one another.

Figure 11:
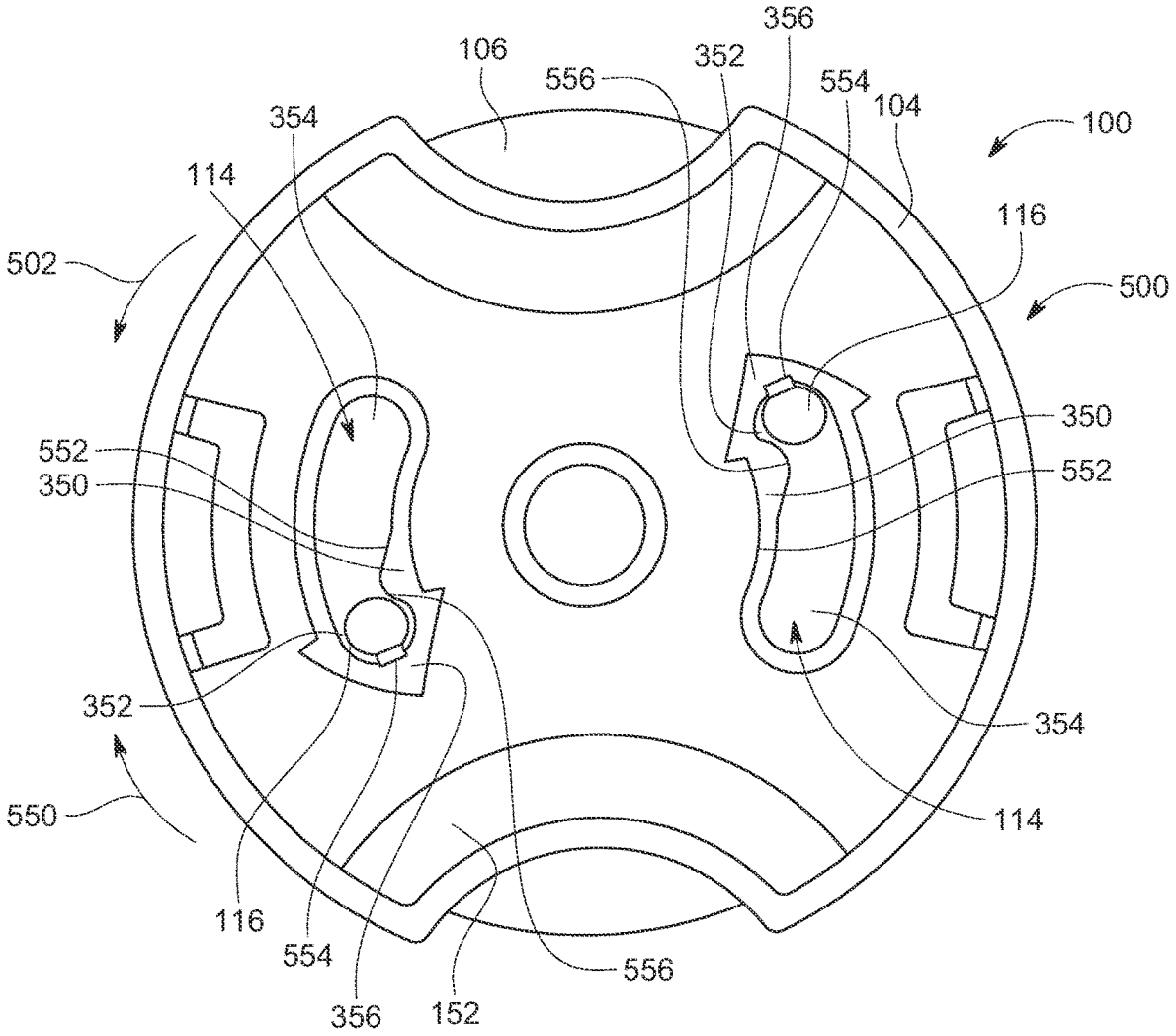
FIG. 11 illustrates a bottom view of the securement assembly of FIG. 10.

FIG. 11 illustrates a bottom view of the securement assembly 100 in the locked configuration 500. In the locked configuration 500, the posts 116 of the support 106 are positioned within the recesses 352. As an example, rotation of the support 106 in the first rotational direction 502 relative to the stand 104 may move the posts 116 within the openings 114 from the main portions 354 toward the recesses 352. Additionally, each protrusion 350 includes a planar face 552 that facilitates movement of the posts 116 into the recesses 352. For example, movement of the support 106 in the first rotational direction 502 engages the posts 116 with the planar face 552 to cause the posts 116 to slide along the planar face 552 and toward the recesses 352.

The protrusions 350 may abut and capture the posts 116 within the recesses 352. As such, the recesses 352 are sized to block relative movement between the stand 104 and the support 106. For example, the positioning of the protrusions 350 within the recesses 352 may block undesirable rotation of the support 106 in a second rotational direction 550 relative to the stand 104 and/or block translational movement of the stand 104 and the support 106 along one another. Furthermore, in some embodiments, the posts 116 include hook portions 554 configured to capture the stand base 152 (e.g., a portion of the indicators 356) to retain the posts 116 within the recesses 352 and further block relative movement between the stand 104 and the support 106. In this manner, undesirable relative movement between the stand 104 and the support 106 may be avoided to secure the stand 104 and the support 106 to one another.

However, it should be noted that a sufficient amount of force may be applied to move the posts 116 out of the recesses 352. By way of example, rotation of the support 106 in the second rotational direction 550 relative to the stand 104 may abut the posts 116 against a curved face 556 of the protrusions 350. Application of additional force to rotate the support 106 in the second rotational direction 550 relative to the stand 104 may cause the posts 116 to slide along the curved faces 556 and out of the recesses 352. After such movement, the stand 104 and the support 106 may be manually decoupled from one another.

Figure 12:
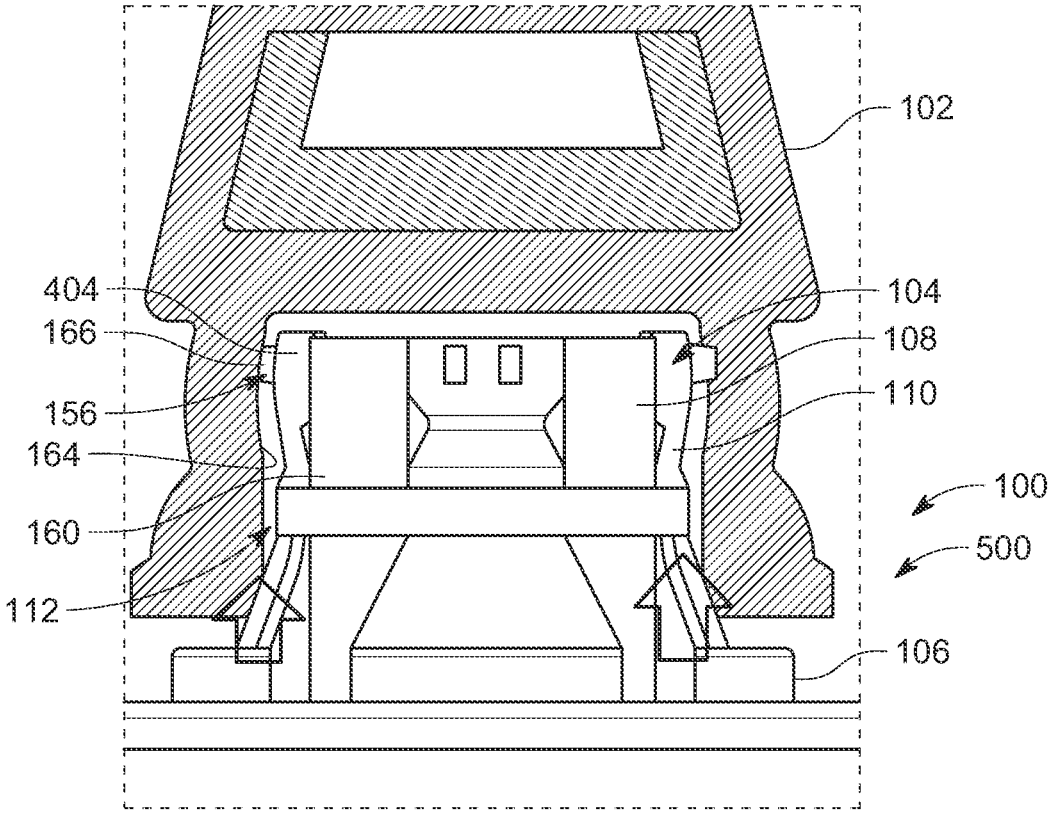
FIG. 12 illustrates a cross-sectional side view of a securement assembly coupled to a toy, in accordance with an example embodiment of the present application.

FIG. 12 illustrates a cross-sectional side view of the securement assembly 100 coupled to the toy 102. For example, the insert 110 of the support 106 is positioned within the receptacle 112 of the toy 102. Additionally, the securement assembly 100 is in the locked configuration 500 in which the extension 108 of the stand 104 is positioned within the space 158 defined by the insert 110 and the projections 160 abut the movable portions 404 of the tabs 156, thereby pushing the tabs 156 against the wall 164 of the toy 102 defining the receptacle 112. Consequently, the ribs 166 of the tabs 156 may press into the wall 164 to secure the support 106 to the toy 102 (e.g., within the receptacle 112). Indeed, the material (e.g., a polymer, a plastic) of the toy 102 may be sufficiently soft to enable the ribs 166 to form an indentation into the wall 164 as a result of pressing into the wall 164, and the indentation of the wall 164 may capture the ribs 166 within the indentation to retain the insert 110 within the receptacle 112. As such, the sufficiently soft property of the toy may help better secure the insert 110 to the toy 102.

Figure 13A:
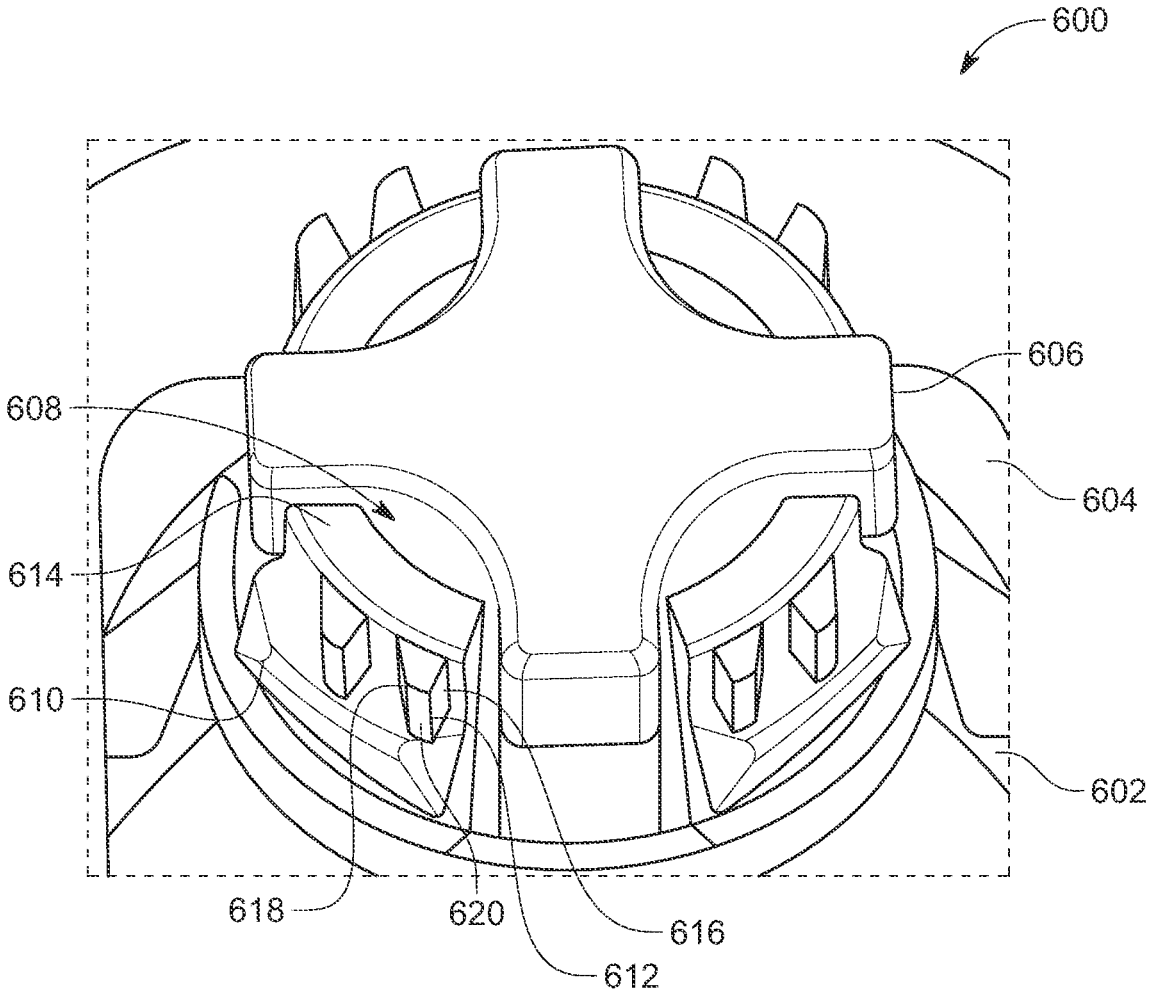
FIGS. 13*a*-13*c* illustrate top perspective views of a securement assembly, in accordance with example embodiments of the present application.
Figure 13B:
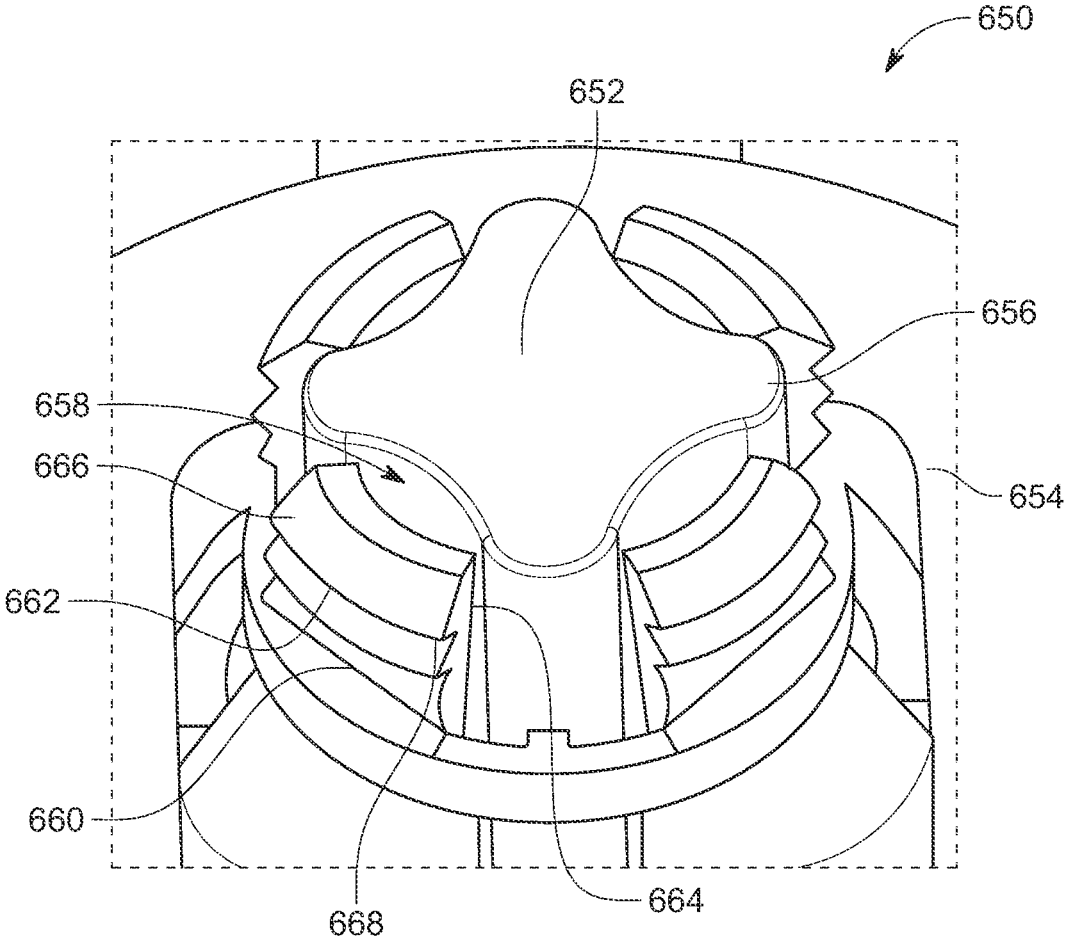
Figure 13C:
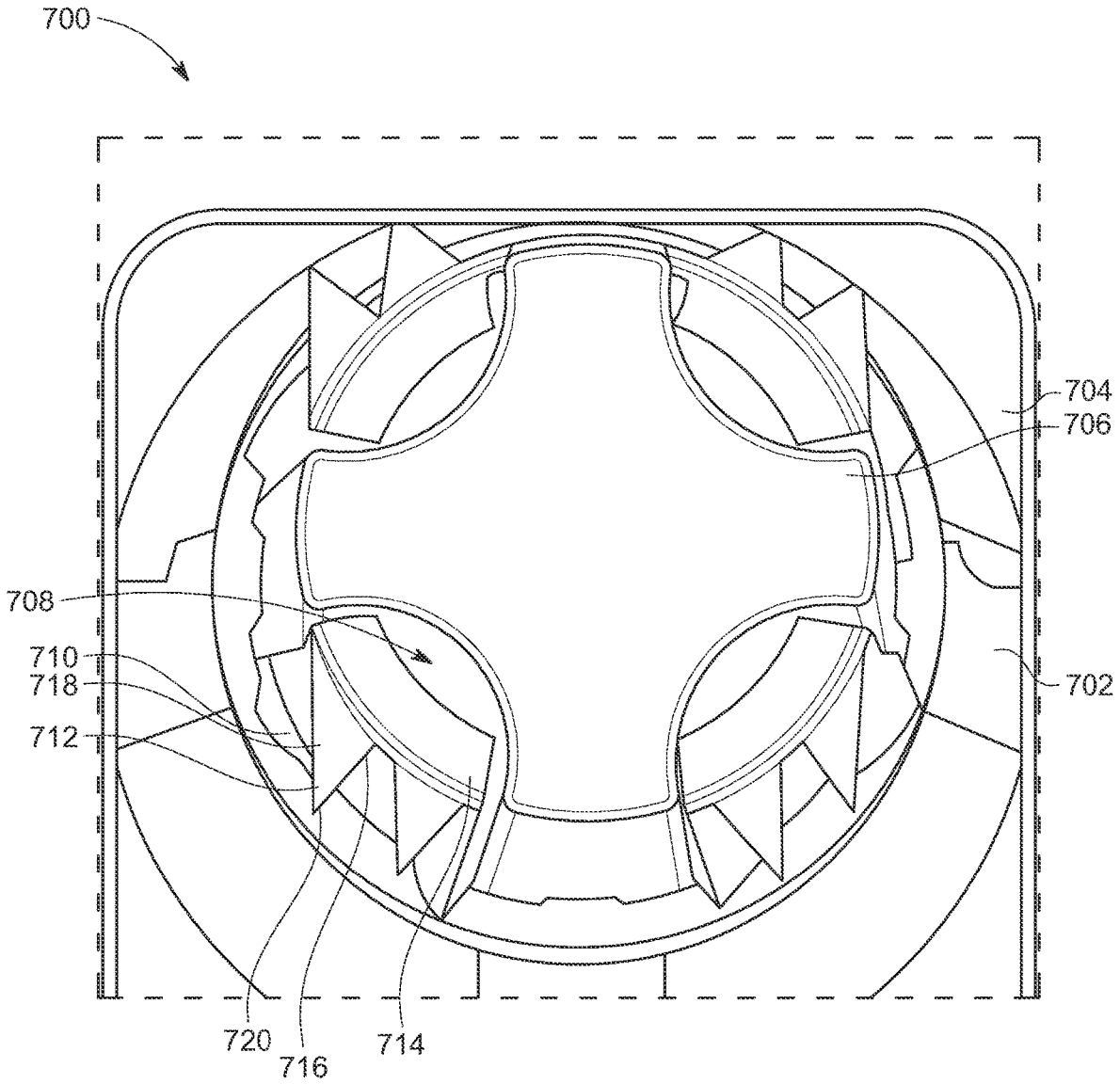

FIGS. 13*a*-13*c* illustrate different embodiments of securement assemblies. In particular, the supports of the different securement assemblies include tabs with differently shaped ribs. The different ribs may provide different features and benefits related to coupling of the securement assembly to a toy.

FIG. 13*a* illustrates a top perspective view of a securement assembly 600 with a stand 602 and a support 604 in which an extension 606 of the stand 602 extends into a space 608 formed by tabs 610 of the support 604. Ribs 612 extend from movable portions 614 of the tabs 610 and away from the space 608. The illustrated ribs 612 have a quadrilateral (e.g., a trapezoidal) configuration. For example, each rib 612 includes a first wall 616 (e.g., a first side wall) extending from the movable portion 614, a second wall 618 (e.g., a second side wall) extending from the movable portion 614 and positioned opposite the first wall 616, and a third wall 620 (e.g., a contact wall) connected to the first wall 616 and to the second wall 618. Positioning the tabs 610 within a receptacle (e.g., the receptacle 112) of a toy (e.g., the toy 102) may abut the third walls 620 against the wall of the toy. As a result, the third walls 620 impart a force (e.g., a frictional force) onto the toy that holds the tabs 610 against the toy, thereby securing the support 604 to the toy.

The third walls 620 may be sized to provide a desirable amount of force that secures the support 604 to the toy without changing a geometry of the toy (e.g., abrading, scratching, piercing, etc. of the toy). For example, the third walls 620 may be sufficiently small to concentrate the force being imparted onto the toy to block relative movement between the toy and the ribs 612. However, the third walls 620 may also be sufficiently large to distribute the force to avoid changing a geometry of the toy upon contacting the toy. For instance, the third walls 620 may generally have a rectangular profile.

The second wall 618 of each rib 612 extends the toward the first wall 616 of the rib 612. However, in additional or alternative embodiments, the first wall 616 and the second wall 618 of one of the ribs 612 may be oriented in any other suitable manner, such as by extending away from one another and/or extending in parallel to one another. The arrangement of the first wall 616 relative to the second wall 618 may form the third wall 620 having the desirable geometry (e.g., size) to provide the force that secures the support 604 to the toy.

FIG. 13*b* illustrates a top perspective view of a securement assembly 650 with a stand 652 and a support 654 in which an extension 656 of the stand 652 extends into a space 658 formed by tabs 660 of the support 654. Ribs 662 extend from movable portions 664 of the tabs 660 and away from the space 658. The illustrated ribs 662 have a barbed configuration in which the ribs 662 extend in a crosswise (e.g., downward) direction from the movable portions 664 to form a ridged or serrated profile. For instance, the ribs 662 have sloped faces 666 and edges 668. The sloped faces 666 may facilitate positioning of the tabs 660 into a receptacle (e.g., the receptacle 112) of a toy (e.g., the toy 102). By way of example, the wall of the toy defining the receptacle may slide along the sloped faces 666 to facilitate insertion of the tabs 660 into the receptacle. The edges 668 may block removal of the tabs 660 from the receptacle. For example, the edges 668 may abut against the wall of the toy to impart a force that blocks relative movement between the toy and the tabs 660. As such, the edges 668 may help secure the toy and the support 654 to one another.

FIG. 13*c* illustrates a top perspective view of a securement assembly 700 with a stand 702 and a support 704 in which an extension 706 of the stand 702 extends into a space 708 formed by tabs 710 of the support 704. Ribs 712 extend from movable portions 714 of the tabs 710 and away from the space 708. The illustrated ribs 712 have a triangular configuration. For example, each rib 712 includes a first wall 716 and a second wall 718. The first wall 716 and the second wall 718 extend from the movable portion 714 toward one another and connect to form a vertex 720 (e.g., a sharp point or edge). Positioning the tabs 710 within a receptacle (e.g., the receptacle 112) of a toy (e.g., the toy 102) may abut the vertices 720 against the wall of the toy. As a result, the vertices impart a force onto the toy that holds the tabs 710 against the toy, thereby securing the support 704 to the toy.

It should be noted that a support of a securement assembly can include any suitable quantity of ribs, as well as any combination of rib embodiments. As an example, different tabs of a securement assembly may have differently shaped ribs (e.g., any of the ribs 612, 662, 712). Additionally or alternatively, a single tab of the securement assembly may have differently shaped ribs (e.g., any of the ribs 612, 662, 712). Moreover, ribs having a different shape than depicted in FIGS. 13*a*-13*c* may be implemented in the support.

Figure 14:
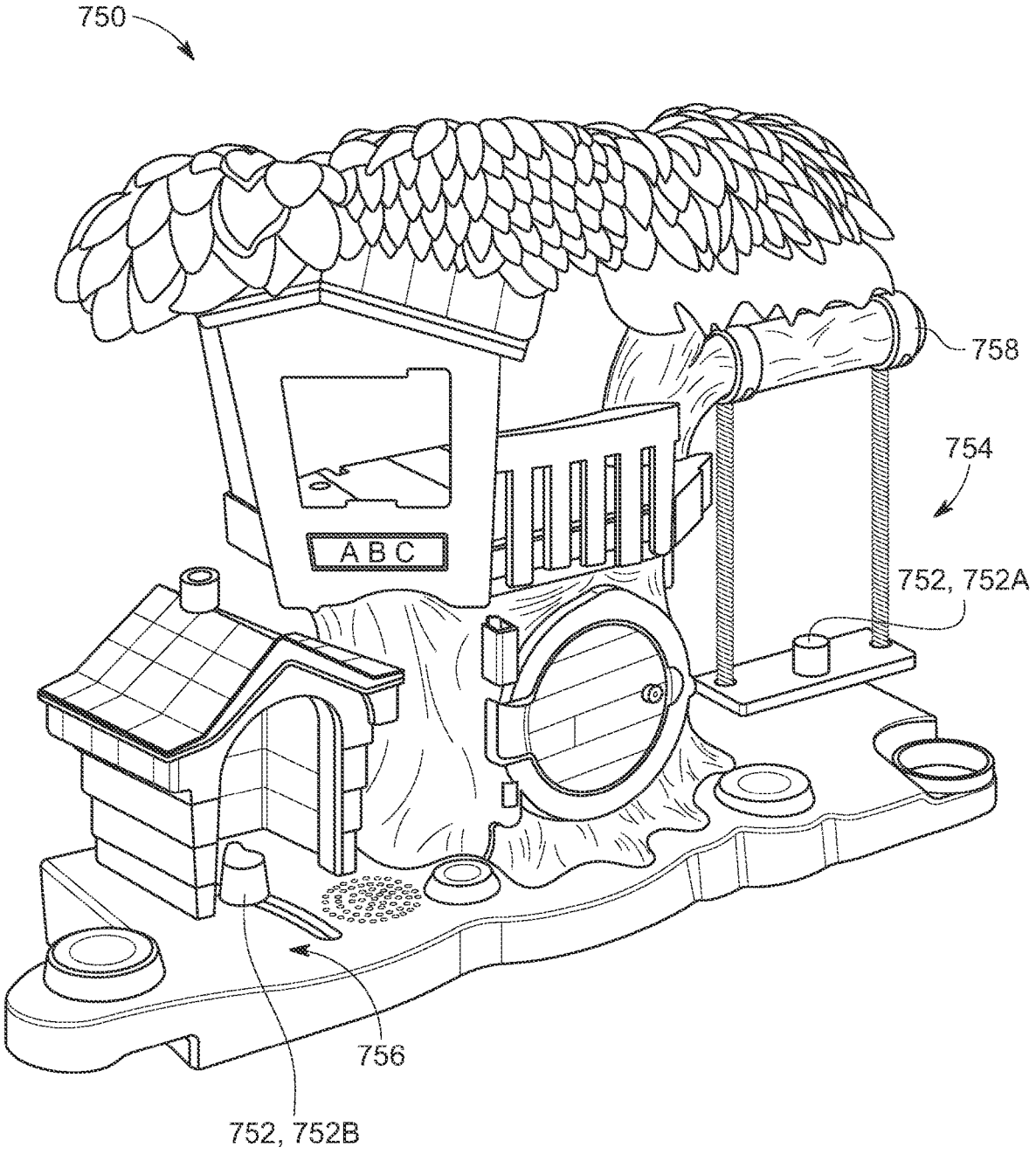
FIG. 14 (PRIOR ART)
FIG. 14 illustrates a perspective view of a toy playset with securement assemblies, in accordance with example embodiments of the present application.

In some embodiments, the toy 102 may be configured to couple to each of a plurality of securement assemblies, such as securement assemblies used for different purposes. For example, the toy 102 can readily couple to a securement assembly used for display of the toy 102, as well as a securement assembly used for play interaction, including an existing securement assembly embodiment. FIG. 14 is a perspective view of an embodiment of a prior art toy playset 750 having a first securement assembly 752A integrated in a first toy component 754 and a second securement assembly 752B movable along a second toy component 756. The toy 102 is configured to separately interchangeably couple to each of the securement assemblies 752, as well as to any of the securement assemblies 100, 600, 650, 700. For instance, the securement assemblies 752 may be an existing component, and the securement assemblies 100, 600, 650, 700 may be manufactured to include similar features (e.g., a similar extension) as that of the securement assemblies 752. Additionally or alternatively, the first toy component 754 and/or the second toy component 756 may be manufactured or retrofitted to integrate any of the securement assemblies 100, 600, 650, 700. In either case, the securement assemblies 752 may be readily coupled to the toy 102 (e.g., by inserting one of the securement assemblies 752 into the receptacle 112 of the toy 102) without having to modify the toy 102 and/or the securement assemblies 752.

By way of example, the first toy component 754 may be a swing configured to move (e.g., rotate relative to a mount 758). Coupling the toy 102 to the first securement assembly 752A of the first toy component 754 secures the toy 102 to the first toy component 754 to maintain positioning of the toy 102 on the first toy component 754 during movement of the first toy component 754. Coupling the toy 102 to the second securement assembly 752B of the second toy component 756 enables the toy 102 to be moved along the second toy component 756 via the second securement assembly 752B. For instance, the second toy component 756 may include a path or floor, and movement of the second securement assembly 752B along the path may help controllably move the toy 102 along the path. Thus, by enabling the toy 102 to readily couple to the securement assemblies 752 (e.g., directly after decoupling the toy 102 from any of the securement assemblies 100, 600, 650, 700), an interactive play experience with the toy playset 750 may be more easily implemented.

While the securement assembly presented herein has been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the securement assembly described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches. Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A securement assembly for a toy, the securement assembly comprising:

a support comprising an insert, wherein the insert comprises a plurality of tabs cooperatively defining a space, and the insert is configured to extend into a receptacle of the toy; and a stand comprising an extension, wherein the extension is configured to extend into the space cooperatively defined by the plurality of tabs so that, in an assembled configuration of the securement assembly, the extension abuts the plurality of tabs to move the plurality of tabs away from one another and into engagement with a wall of the toy defining the receptacle.

2. The securement assembly of claim 1, wherein the stand comprises an opening, and the support comprises a post configured to extend into the opening in the assembled configuration of the securement assembly.

3. The securement assembly of claim 2, wherein the stand comprises a protrusion defining a recess within the opening, and the protrusion is configured to capture the post within the recess in the assembled configuration of the securement assembly.

4. The securement assembly of claim 1, wherein the support comprises a flange, and the stand comprises a hook configured to capture the flange in the assembled configuration of the securement assembly.

5. The securement assembly of claim 1, wherein the support comprises a ring coupled to the plurality of tabs, and the ring is configured to block deformation of the plurality of tabs beyond a threshold.

6. The securement assembly of claim 1, wherein each tab of the plurality of tabs comprises a neck portion configured to facilitate movement of the plurality of tabs away from one another via abutment with the extension of the stand.

7. The securement assembly of claim 1, comprising an enclosure, wherein the stand is configured to couple to the enclosure to position the toy within the enclosure in the assembled configuration of the securement assembly.

8. The securement assembly of claim 7, wherein the enclosure comprises walls configured to capture edges of the stand to couple the stand to the enclosure.

9. A system, comprising:

a toy comprising a wall defining a receptacle; and a securement assembly comprising:

a plurality of tabs cooperatively defining a space and configured to extend into the receptacle of the toy; and an extension configured to extend into the space cooperatively defined by the plurality of tabs to abut the plurality of tabs and move the plurality of tabs away from one another and into engagement with the wall of the toy to couple the securement assembly to the toy within the receptacle.

10. The system of claim 9, wherein the extension comprises a plurality of projections configured to abut the plurality of tabs to move the plurality of tabs away from one another.

11. The system of claim 9, wherein the securement assembly comprises a base, each tab of the plurality of tabs comprises a fixed portion and a movable portion, the fixed portion extends from the base, and the extension is configured to abut the movable portion of each tab of the plurality of tabs to move the movable portion of each tab of the plurality of tabs away from one another.

12. The system of claim 11, wherein each tab of the plurality of tabs comprises a rib extending from the movable portion away from the space defined by the plurality of tabs, and the rib is configured to engage with the wall of the toy.

13. The system of claim 12, wherein the toy comprises a cutout formed into the wall, the rib of a tab of the plurality of tabs is configured to extend into the cutout, and the wall captures the rib of the tab of the plurality of tabs within the cutout to block relative movement between the toy and the plurality of tabs.

14. The system of claim 11, comprising a ring coupled to the plurality of tabs, wherein the ring is configured to block movement of the fixed portion of the plurality of tabs relative to the base.

15. The system of claim 11, wherein each tab of the plurality of tabs comprises a neck portion extending between the fixed portion and the movable portion, and the neck portion comprises a reduced thickness relative to the fixed portion and relative to the movable portion to facilitate movement of the movable portion relative to the fixed portion.

16. The system of claim 9, comprising an additional toy, wherein the additional toy comprises an additional securement assembly, and the toy is configured to interchangeably couple to the securement assembly and the additional securement assembly.

17. A securement assembly for a toy, the securement assembly comprising:

a support comprising a support base and a plurality of tabs extending from the support base, wherein the plurality of tabs is configured to extend into a receptacle of the toy; and a stand comprising a stand base and an extension extending from the stand base, wherein the extension is configured to extend between the plurality of tabs and to engage with the plurality of tabs to move the plurality of tabs away from one another and into engagement with the toy within the receptacle.

18. The securement assembly of claim 17, wherein the support comprises a flange extending from the support base, the stand comprises a hook extending from the stand base, and the hook is configured to capture the flange.

19. The securement assembly of claim 18, wherein the support comprises an additional flange, the flange and the additional flange are separated from one another by a gap, and the hook is configured to extend through the gap to abut the stand base and the support base against one another.

20. The securement assembly of claim 18, wherein the support comprises a stop configured to abut the hook of the stand to block relative movement between the support and the stand.

* * * * *